US006318568B1

(12) United States Patent
Mc Cord

(10) Patent No.: US 6,318,568 B1
(45) **Date of Patent: *Nov. 20, 2001**

(54) INSTALLATION FOR STORING AND HOLDING GAS CYLINDERS

(75) Inventor: Anthony Mc Cord, Paris (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/705,888

(22) Filed: Nov. 6, 2000

Related U.S. Application Data

(62) Division of application No. 09/259,262, filed on Mar. 1, 1999, now Pat. No. 6,161,706.

(30) Foreign Application Priority Data

Feb. 27, 1998 (FR) ..... 98 02426

(51) Int. Cl.[7] ..... A47G 29/00
(52) U.S. Cl. ..... 211/85.18
(58) Field of Search ..... 211/85.18

(56) References Cited

U.S. PATENT DOCUMENTS

| | | | | |
|---|---|---|---|---|
| 2,221,967 | | 11/1940 | Farrar . | |
| 2,278,232 | | 3/1942 | Anderson . | |
| 3,602,368 | * | 8/1971 | Gould | 211/85.18 X |
| 3,708,985 | * | 1/1973 | Pogonowski et al. | 61/46.5 |
| 3,765,635 | | 10/1973 | Burrell et al. . | |
| 3,791,403 | * | 2/1974 | Folkerth | 211/85.18 X |
| 4,168,077 | | 9/1979 | Rohatensky . | |
| 4,475,481 | | 10/1984 | Carroll . | |
| 5,025,935 | | 6/1991 | Hadachek . | |
| 5,072,174 | * | 12/1991 | Weber | 324/149 |
| 5,100,007 | | 3/1992 | Espasandin et al. . | |
| 5,176,265 | | 1/1993 | Bennett . | |
| 6,161,706 | * | 12/2000 | McCord | 211/85.18 |

FOREIGN PATENT DOCUMENTS

| | | |
|---|---|---|
| 1531622 | 11/1968 | (FR) . |
| 1574061 | 7/1969 | (FR) . |
| 2288103 | 10/1995 | (GB) . |

* cited by examiner

*Primary Examiner*—Daniel P. Stodola
*Assistant Examiner*—Erica B. Harris
(74) *Attorney, Agent, or Firm*—Young & Thompson

(57) ABSTRACT

The installation comprises, along a vertical frame (1), locations for gas cylinders, these locations being partially defined by a rack that can be used for transporting the cylinders (7), each location comprising, on the frame, a holding device (9, 10) that can be swung between a lockable closed configuration preventing the insertion or extraction of a cylinder, and an open configuration.

11 Claims, 3 Drawing Sheets

INSTALLATION FOR STORING AND HOLDING GAS CYLINDERS

CROSS-REFERENCE TO RELATED APPLICATIONS

This application is a division of allowed application Ser. No. 09/259,262, filed Mar. 1, 1999, now U.S. Pat. No. 6,161,706.

FIELD OF THE INVENTION

The present invention relates to installations for storing and holding gas cylinders, more particularly of the type comprising at least two locations for accommodating cylinders, each location being provided with a holding device that can be moved between an open configuration, giving access to and from the location, and a closed configuration preventing access to and especially extraction of a cylinder from the temporary-storage location and its return to a location.

BACKGROUND OF THE INVENTION

Installations of this type are described in Patent Application PCT/FR97/02239 in the name of the applicant company, the content of which is incorporated herein for reference.

SUMMARY OF THE INVENTION

This patent application is intended to propose new improved installations of simplified structure and operation and with better reliability and security.

To achieve this, according to one feature of the invention, each holding device comprises at least one structure having at least one enveloping profile which can be rotated about at least one axle between the closed configuration and an open configuration releasing the cylinder, the structure comprising at least one hoop which passes around the body of the cylinder in the closed configuration.

According to other features of the invention:

the structure includes a part in the form of a substantially semicylindrical or prismatic hood for enclosing at least the head of the cylinder in the closed configuration, the axle is vertical or horizontal, the holding devices are mounted on a common frame, typically vertical and substantially flat, advantageously including adjacent cylinder-holding locations on at least one of its vertical faces.

According to other aspects of the invention, the accommodating locations are at least partially defined by a removable rack, advantageously including means for co-operating with a lifting/transporting device, and used for transporting, positioning in place and taking away a set of cylinders, each holding device includes an electronic device for conversing with an electronic tag borne by the cylinder, the electronic device typically including an antenna mounted on a moving part of the holding device.

BRIEF DESCRIPTION OF THE DRAWINGS

Other features and advantages of the present invention will emerge from the following description of one embodiment, given by way of illustrative but non-limiting example, made with reference to the appended drawings, in which.

DETAILED DESCRIPTION OF THE INVENTION

Figure 1:
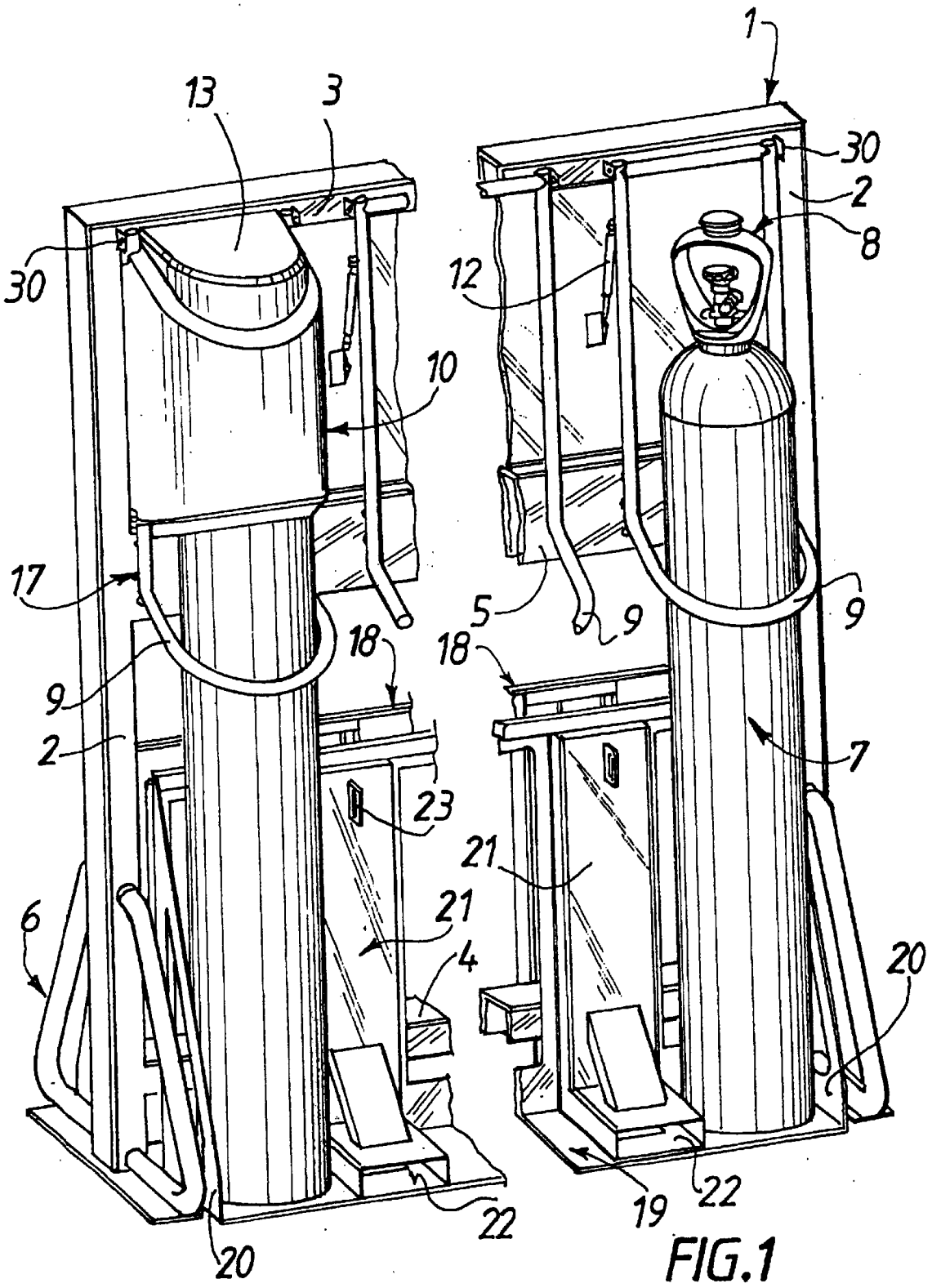
FIG. 1 is a partially cutaway perspective view of one embodiment of an installation according to the invention.

In the description which will follow and in the drawings, elements which are identical or similar bear the same reference numerals, possibly with a suffix.

The installation for storing and holding gas cylinders, depicted in FIG. 1, includes, in general, a metal frame 1, which is lightweight and can be transported onto site, of rectangular and essentially flat configuration, consisting of a pair of vertical uprights 2, an upper crossmember 3, a lower crossmember 4 and an intermediate crossmember 5. The uprights 2 at their base have crossbracing or a tripod 6 for making them more rigid and for mounting them on a floor covering.

The frame 1 is sized, in terms of height and in terms of width, so that a certain number, depending on their size and capacity, of gas cylinders 7, each comprising a head 8 consisting of a gas valve assembly and of a bonnet for protecting this valve can stand up against it.

Figure 2:
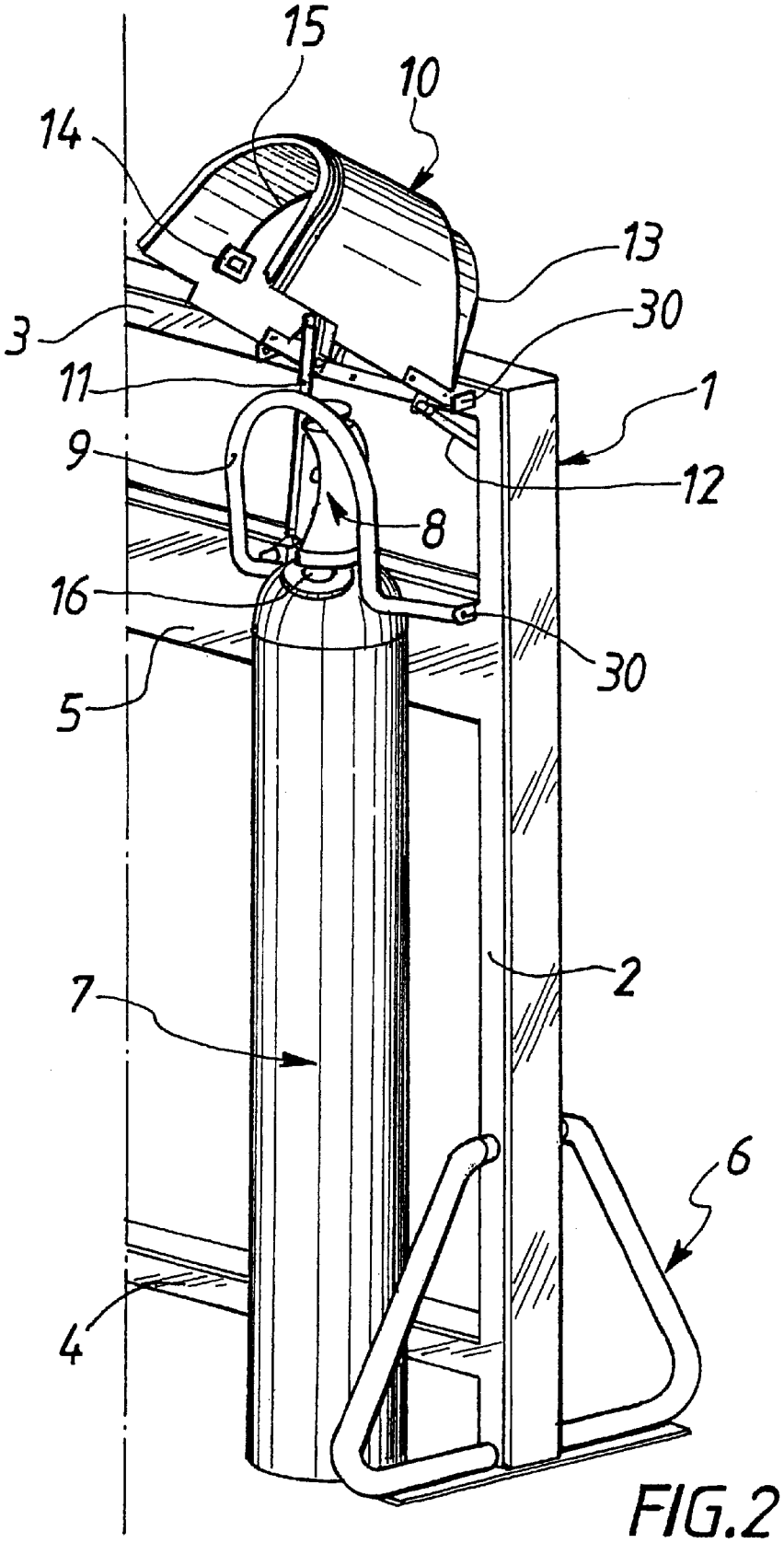
FIG. 2 is a view of an alternative form showing the hood and the hoop in the open position.

As can be seen in FIG. 1, associated with each cylinder location along the frame 1 is a holding device that can be swung vertically about a horizontal axle 30 and which consists of a combined assembly of a retaining hoop 9 which passes around the cylinder substantially in its upper third, and a hood or cap 10 which covers the top of the cylinder and, in the closed position, completely encloses the head 8, preventing any access thereto. The hoop 9 and the hood 10 swing simultaneously, forming a single assembly, as depicted in FIG. 1, or two assemblies articulated about separate horizontal axles, coupled together by at least one link rod 11, as depicted in FIG. 2, to open and close simultaneously, opening advantageously being assisted, for example, by a gas spring 12 bearing against the frame 1. In the embodiment of FIG. 1, the hoop 9/hood 10 assembly is mounted articulated on the upper crossmember 3 by the ends of the lateral arms of the hoop 9 and the spring 12 acts on one arm of the hoop. In the embodiment of FIG. 2, the hoop 9 is mounted articulated, by the ends of its lateral arms, which in this case are shorter, on the intermediate crossmember 5, the hood 10 being mounted articulated, by its top corners, on the upper crossmember 3. In the embodiment of FIG. 2, the assistance spring 12 acts on the hood 10.

As a general rule, the hoop 9 has, when viewed face on, the overall configuration of a U, the width between the branches of the U corresponding to the diameter of the cylinder 7, and, when viewed side on, the configuration of an open L, to allow it to clear the head 8 of the cylinder when in the open configuration. The hood 10 has a semicylindrical overall configuration which is closed at its upper part by an inclined roof part 13. Advantageously, the hood 10 forms a continuous unperforated shell made of technical-grade plastic. As depicted in FIG. 2, it advantageously has, on its internal face, an electronic circuit 14 associated with an antenna 15 running along the hood 10 to read, or preferably converse with, an electronic tag 16 fixed to the neck of the cylinder 7 when this cylinder is equipped with such identification and tracing means. The antenna alone may be mounted on the internal face of the hood 10, or in the hoop 9, by being connected to a circuit 14 mounted stationary in a unit on the frame 1.

As described in the aforementioned document PCT/FR97/02239, the hoop 9 and hood 10 gear includes means capable of co-operating with an electromagnetic catch borne by the frame to selectively allow the assembly to be opened and/or closed as a function of access-clearance sequences described in the aforementioned document. Typically, as illustrated schematically in FIG. 1, one of these elements 9 and 10 includes a bolt element which can be inserted in a keeper 17 of an electromagnetic catch (not depicted) mounted on the frame 1.

The cylinders 7 may be placed directly on the floor covering of the frame 1, as depicted in FIG. 2, the sizes and positions of the hoop 9 and of the hood 10 preventing any extraction of the cylinder from its housing by tilting it when the hoop and the hood are lowered. Advantageously, according to one aspect of the invention, the cylinders 7 are arranged in housings of a rack 18 of L-shaped overall configuration which can be housed along one of the vertical faces of the frame 1, resting on the floor covering. The rack 18 includes a baseplate 19, forming the short leg of the L, on which the cylinders 7 rest, these being held laterally by end plates 20 and the lateral faces of a U-shaped section piece 21, the horizontal bottom parts of which form tunnels 22 the size of the forks of fork-lift trucks for transporting and installing the rack equipped with these cylinders, the latter typically being held in place in the rack during transport and handling by straps (not depicted) passing through runners 23 of the rack 18. As can be seen in FIG. 1, each frame 1 advantageously accommodates a rack 18 on each of its vertical faces, one of the racks being full of full cylinders to be taken away, the other empty to receive empty cylinders to be exchanged according to the procedures described in the aforementioned document PCT/FR97/02239.

Figure 3:
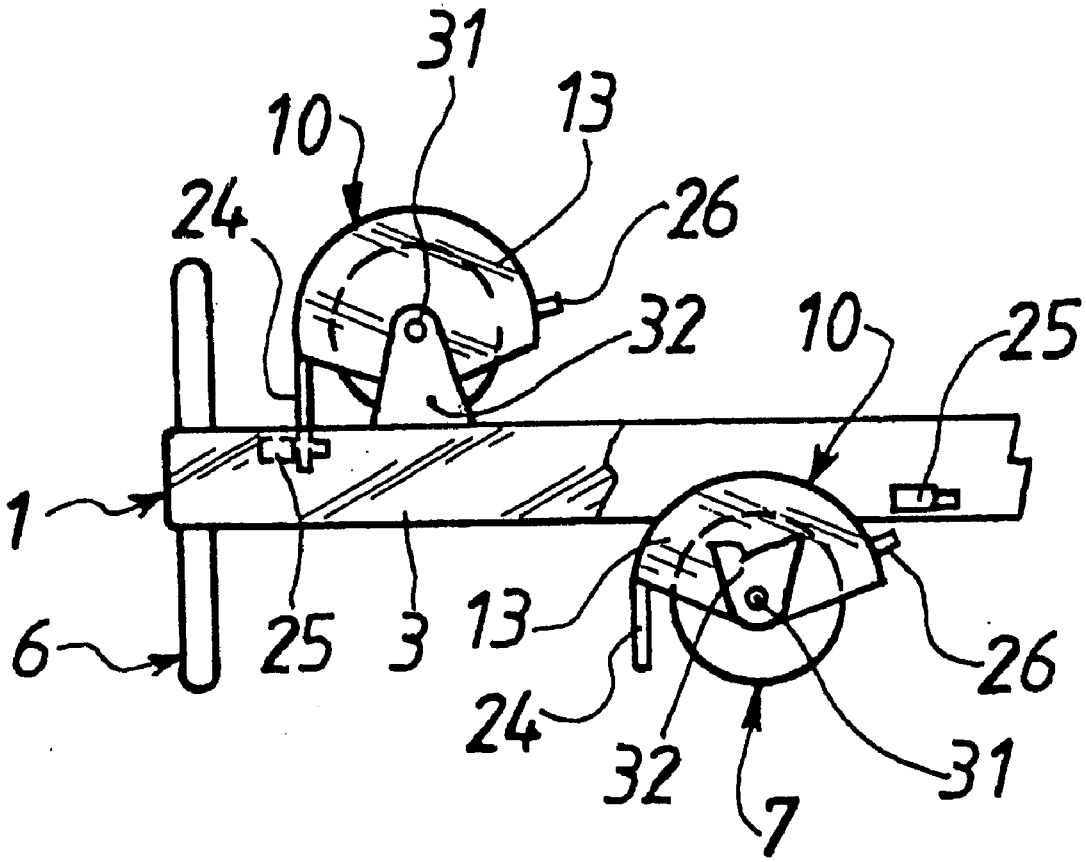
FIG. 3 is a diagrammatic plan view of another embodiment of the invention.

In the embodiment depicted in FIG. 3, there can be seen, in plan view, the frame 1 with, one on each side, two cylinders 7. In this embodiment, the structure with the enveloping profile comprises a semicylindrical hood 10 with a roof part 13 supported in rotation about a vertical axle 31 substantially concentric with the cylinder 7 in position in its housing, on a lug 32 which projects laterally from the upper crossmember 3. The solid side wall of the hood 10 is extended in the direction beyond the axle 31 by a lug 24 forming the bolt which can be inserted in the keeper of the electromagnetic catch 25 borne by the frame 1 in the closed configuration depicted in the left-hand part of FIG. 3. In the open configuration, which is depicted in the right-hand part of FIG. 3, the hood 10 is rotated to the rear, about the axle 31, to become partially housed in the frame 1 until it reaches a wide open configuration which is defined by a projection 26 of the hood 10 coming into abutment against the frame 1. In an alternative version of the embodiment of FIG. 3, the holding device may, in addition to the hood 10, comprise a filiform hoop which passes around an intermediate part of the cylinder, moving about a vertical axis concentric with the cylinder or offset from the axis of the cylinder, the hood 10 in this case advantageously also being mounted to rotate about a vertical axis which is also offset from that of the cylinder and close to the axis of the hoop if the latter and the hood remain coupled.

Although the present invention has been described in conjunction with particular embodiments, it is not restricted thereto but on the contrary can be modified and varied in ways which will be obvious to the person skilled in the art in the context of the claims which follow.

What is claimed is:

1. A device for storing and holding at least two gas cylinders, comprising a stationary vertical stand part having a base portion for fixing to a floor and at least one separate, transportable, cylinder-supporting rack positionable at the base of the stand part; the rack having a base plate and defining at least two cylinder positioning spaces, each for freely supporting a cylinder; the vertical stand part carrying at least two horizontally spaced cylinder holding means, each having a holding structure movable between an open position and a closed position, where the holding structure surrounds, at least partially, at least an upper part of a cylinder placed vertically on the base plate of the rack.

2. The device of claim 1, wherein the stand part has lateral vertical uprights defining between them a space for accommodating at least part of the rack.

3. The device of claim 1, wherein the rack comprises horizontally spaced guides extending vertically from the base plate and defining recesses for accommodating cylinder bases.

4. The device of claim 3, wherein the rack further comprises releasable means for holding the cylinders in the cylinder positioning spaces when transporting the rack.

5. The device of claim 1, wherein the rack has a substantially L-shaped configuration, the base plate forming a branch of the L.

6. The device of claim 1, wherein the holding structure is rotatable about a horizontal axis.

7. The device of claim 1, wherein the rack includes means for cooperating with a lifting/transporting apparatus.

8. The device of claim 7, further comprising remotely actuatable locking means for selectively locking the holding structure in the closed position.

9. The device of claim 7, wherein the holding structure includes a hood part enclosing at least the head of a cylinder placed on the base plate of the rack when in the closed position.

10. The device of claim 7, wherein the holding structure is rotatable about a vertical axis.

11. The device of claim 7, wherein the holding structure carries a first electronic circuit adapted to converse, in the closed position, with a second electronic circuit on the cylinder.

* * * * *